US011188031B2

(12) United States Patent
Peter et al.

(10) Patent No.: US 11,188,031 B2
(45) Date of Patent: Nov. 30, 2021

(54) TIMEPIECE WITH STRIKING MECHANISM AND RELEASE-PREVENTION DEVICE

(71) Applicant: Blancpain SA, Le Brassus (CH)
(72) Inventors: Julien Peter, Gollion (CH); Mehdi Denden, Les Rousses (FR)
(73) Assignee: Blancpain SA, Le Brassus (CH)

( * ) Notice: Subject to any disclaimer, the term of this patent is extended or adjusted under 35 U.S.C. 154(b) by 424 days.
(21) Appl. No.: 16/386,304
(22) Filed: Apr. 17, 2019
(65) Prior Publication Data
US 2019/0361401 A1 Nov. 28, 2019
(30) Foreign Application Priority Data
May 28, 2018 (EP) ..... 18174636
(51) Int. Cl.
*G04B 21/06* (2006.01)
*G04B 21/12* (2006.01)
(52) U.S. Cl.
CPC ..... *G04B 21/06* (2013.01); *G04B 21/12* (2013.01)
(58) Field of Classification Search
CPC ..... G04B 21/00; G04B 21/02; G04B 21/04; G04B 21/06; G04B 21/10; G04B 21/12
See application file for complete search history.

(56) References Cited

U.S. PATENT DOCUMENTS 7,420,882 B2 * 9/2008 Goeller ..... G04B 21/12 368/267
7,443,769 B2 * 10/2008 Goeller ..... G04B 21/12 368/190
2007/0147183 A1 * 6/2007 Goeller ..... G04B 21/12 368/269
2012/0230156 A1 9/2012 Goeller
(Continued)

FOREIGN PATENT DOCUMENTS

EP 1 760 551 A1 3/2007
EP 2 498 143 A1 9/2012
(Continued)

OTHER PUBLICATIONS

European Search report dated Dec. 3, 2018 in European Application 18174636.3, filed on May 28, 2018 (with English Translation of categories of Cited Documents).
(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A timepiece with a striking mechanism having a detent ratchet cooperating with a passing strike actuation click controlled by a movement or a repeater click operable by a user, including an uncoupling lever preventing access of the click to the ratchet under the action of a reversing lever operable by a hand-setting stem, or by a main strike function or tune selection control member, or by a stopping mechanism, and including a safety device for preventing release during a strike mode or tune selection, arranged to prevent the release of any strike function by the movement or by a user, and which includes a release-prevention lever, the pivoting of which, under action on the main control member, moves any click away from the detent ratchet.

19 Claims, 13 Drawing Sheets

(56) References Cited

U.S. PATENT DOCUMENTS

| | | | | |
|---|---|---|---|---|
| 2017/0060095 | A1* | 3/2017 | Behra | G04B 23/005 |
| 2019/0033788 | A1* | 1/2019 | Denden | G04B 23/026 |
| 2019/0187621 | A1* | 6/2019 | Feyer | G04B 21/04 |
| 2019/0187627 | A1* | 6/2019 | Feyer | G04B 25/00 |

FOREIGN PATENT DOCUMENTS

| | | |
|---|---|---|
| EP | 2 498 143 B1 | 9/2012 |
| EP | 3 136 188 B1 | 4/2018 |

OTHER PUBLICATIONS

Combined Chinese Office Action and Search Report dated Aug. 26, 2020, in Patent Application No. 201910443803.7 (with English translation), 9 pages.

Office Action dated Sep. 2020 in corresponding Korean Patent Application No. 10-2019-0060691 (with English Translation), 7 pages.

* cited by examiner 1000
100
S1
S2

1000
100
8
87
78
780
7
71
S2
22
25
51
73
72
2
3
4
5
70
6
43
44
9
32
46
31
45
29
42
17
11
10
28
20
30
41
40
44
25
12
24
23
21
15
16
1

1000
100
8
87
78
780
7
71
22
25
2
3
4
6
31
11
10
12
28
20
30
41
24
23
9
14
72
51
5

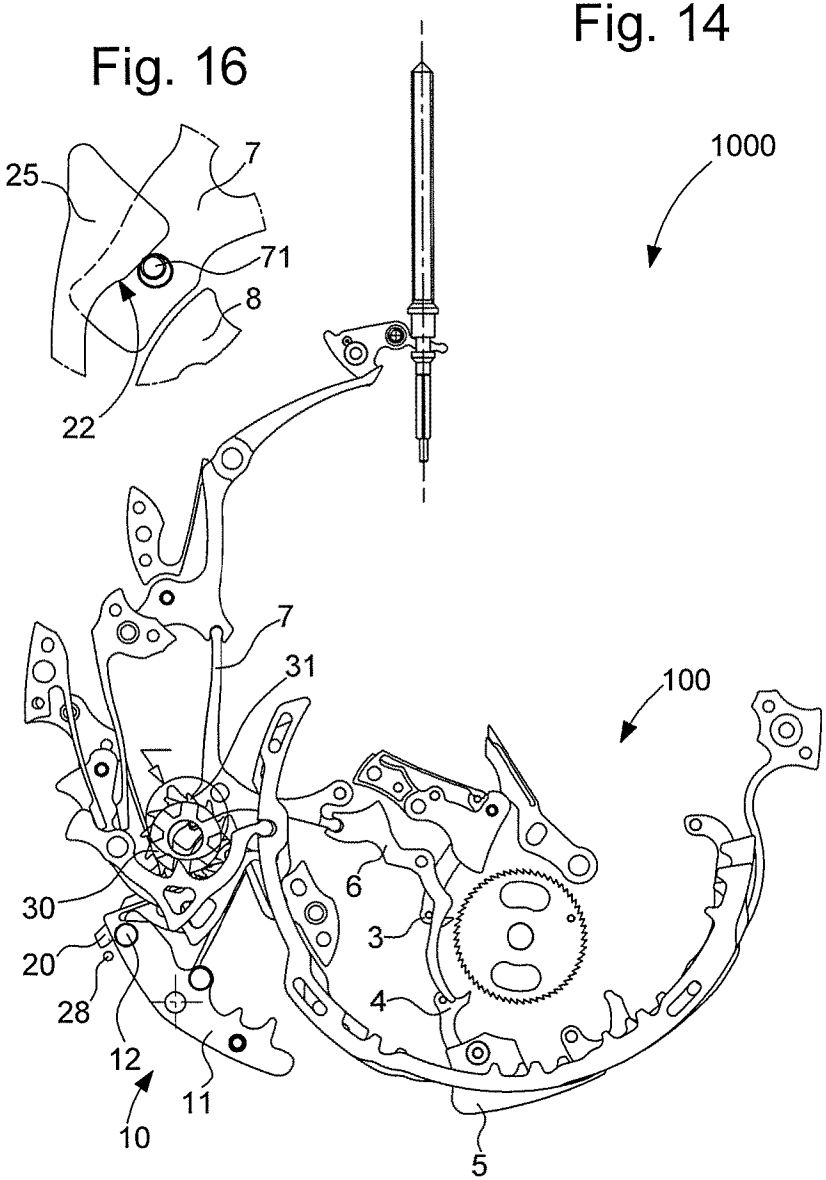
Fig. 14
Fig. 16
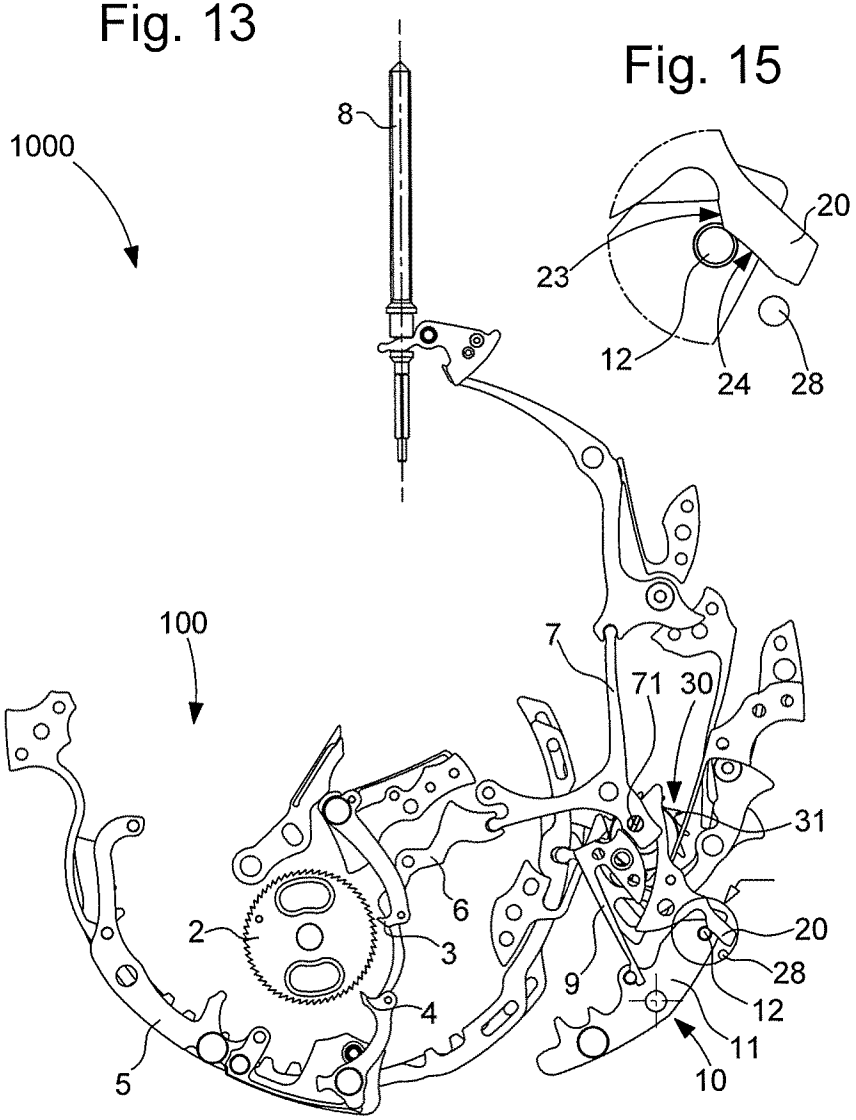
Fig. 15
Fig. 13

1000
100
5
3
6
4
7
31
11
10
20
30
25
8
71
22
28
12
24
23
9
2

1000
100
S1
S2
2
3
4
5
6
7
8
9
10
11
12
20
22
23
25
28
30
31
71

4
5

78

73

7
71
7

1000
500
100
5

6

71
70
72
3

1
2

TIMEPIECE WITH STRIKING MECHANISM AND RELEASE-PREVENTION DEVICE

CROSS-REFERENCE TO RELATED APPLICATION

This application claims priority to European Patent Application No. 18174636.3 filed on May 28, 2018, the entire disclosure of which is hereby incorporated herein by reference.

FIELD OF THE INVENTION

The invention concerns a timepiece including a movement and a striking mechanism, which includes a strike drive wheel set carrying a detent ratchet which is arranged to cooperate with at least one passing strike actuation click controlled by said movement or a repeater click controlled by a user-operated, on-demand release lever, said striking mechanism including a strike-uncoupling lever able to prevent access of a said click to said detent ratchet under the action of a strike reversing lever which is operable, either by a hand-setting stem comprised in said movement, or by a main strike or tune selection control member comprised in said striking mechanism, or, in case of insufficient energy resource, by a stopping mechanism comprised in said striking mechanism.

The invention concerns the field of acoustic display mechanisms for horology, and in particular striking mechanisms and/or music boxes, for performing strike functions, or playing chimes or tunes, automatically or on demand. More particularly, the invention concerns the field of musical watches having a mechanical movement with a striking and/or tune playing mechanism.

BACKGROUND OF THE INVENTION

Timepiece striking mechanisms are large complications, which are complex as regards not only the number and complexity of the kinematics of their components, but also their possible operating modes. For watches that have additional complications, such as minute repeaters, managing the safety features is very complex, and it is difficult to stop the passing strike function to allow a minute repeater to play, or conversely, to stop a minute repeater being released as a passing strike approaches, to prevent a minute repeater being released again when a repeater cycle has just started, to prevent an adjustment to the motion work during a striking function, etc., as these safety means generally employ quite a large number of isolators, which further complicates the mechanism and the risk of interference.

The problem is even more complicated for a timepiece capable of operating in different strike modes, with distinct tunes, notably chimes, or with different sets of gongs, when this timepiece includes means for selecting the strike mode, tune or gongs. It is a question of ensuring complete safety, not only of the components of the striking mechanism or musical mechanism, but also of this equally complex selection mechanism. It is especially necessary to prevent accumulations of stress in the mechanism, in particular in the gathering pallets, and especially to prevent any collision between the quarter racks and the gathering pallets.

European Patent Applications EP2947523B1, EP3096189B1, EP3136188B1, and Swiss Patent Applications CH01718/16, CH00964/17, CH00965/17, CH00966/17, by the same Applicant, already address various aspects of this difficult issue, since it is a question, on the one hand, of preventing the user from starting an action to select or release a strike function or tune at an inopportune moment, and on the other hand, of preventing the timepiece mechanism from starting a strike or tune cycle when the user is performing an action on any of the manual control means of the timepiece. In particular, Swiss Patent Application CH01422/17 by the same Applicant discloses a safety mechanism for the hand-setting function, for a striking mechanism with a governor.

SUMMARY OF THE INVENTION

The invention more particularly proposes to prevent any release of the striking mechanism or playing of a tune, when the user is operating the manual selection means. To this end, the invention concerns a timepiece according to claim 1.

BRIEF DESCRIPTION OF THE DRAWINGS

Other features and advantages of the invention will appear upon reading the following detailed description, with reference to the annexed drawings, in which:

FIGS. 1 to 20 represent partial schematic views of the same striking mechanism according to the invention, with a manual control member for selecting the strike mode and/or tune, at different successive instants, in groups of four Figures, respectively representing front and back views, and detail views at the two ends of a release-prevention lever:

FIGS. 1 to 4 in the rest position, with the manual control member inoperative;

FIGS. 5 to 12 illustrate a first angular travel:

FIGS. 5 to 8 at the start of pressure on the manual control member in a first part of the first angular travel;

FIGS. 9 to 12 during continued pressure on the manual control member, in a second part of the first angular travel;

FIGS. 13 to 20 illustrate a second angular travel:

FIGS. 13 to 16 at the end of the idle travel, in a position where the safety device is engaged;

FIGS. 17 to 20 at the end of travel of pressure on the manual control member, the change of strike mode or tune then being made;

FIG. 25 shows a strike-uncoupling lever;

FIG. 26 represents an assembled drive wheel set, including a detent ratchet;

FIG. 27 represents an intermediate release lever, including a passing strike actuation click, for release of the striking mechanism by the movement;

FIG. 28 represents a grand sonnerie engagement star;

FIG. 29 represents an on-demand release lever, carrying a repeater click, for release of the striking mechanism by the user;

FIG. 30 represents a disengagement yoke;

FIG. 31 represents a strike reversing lever;

FIG. 32 represents an engagement yoke;

FIG. 33 represents a column wheel;

FIG. 34 represents a column wheel jumper;

FIG. 35 represents a main operating lever, notably a column wheel operating lever;

FIG. 36 represents a release-prevention lever according to the invention;

FIG. 37 represents a column-wheel control spring;

FIG. 38 represents a release-prevention lever spring;

FIG. 42 illustrates the configuration where the striking mechanism is at rest, and where the safety device is released;

FIG. 43 illustrates the configuration where the striking function is in progress, and where the safety device is engaged;

FIGS. 44 and 45 are similar to FIGS. 42 and 43 respectively, with some components not represented to display the mechanism more clearly;

FIG. 46 represents the minute rack, which includes a path concentric to its axis of pivoting, interrupted by a disengagement ramp;

FIG. 47 represents the tune selection-prevention lever;

FIG. 48 represents the tune selection bolt, which is a cam cooperating with the main operating lever of FIG. 35;

FIG. 49 represents a tune selection-prevention lever spring, which pushes said tune selection-prevention lever towards the minute rack;

DETAILED DESCRIPTION OF PREFERRED EMBODIMENTS

The invention concerns a timepiece 1000, more particularly a watch, including a movement 500, and a striking mechanism 100. This timepiece 1000 may also be a music box or include a music box.

The work by Francois LECOULTRE entitled '*Les montres compliquées*' (A Guide to Complicated Watches) 1985, ISBN 2-88175-000-1, explains, in detail, the basic mechanisms forming striking mechanisms, at pages 97 to 205, in different chapters:

repeating watches,
old repeating watches,
modern quarter-repeater,
simplified repeater,
half-quarter repeater,
Breguet half-quarter repeater,
five minute-repeater,
minute-repeaters
clock watches Unless necessary, these basic mechanisms will not be discussed here in detail, since striking mechanism specialists will know how to find the composition of such mechanisms in this universal reference work, in particular in the aforementioned last two chapters.

Striking mechanism 100 includes, in a conventional manner, at least one reference wheel set, and preferably a plurality of reference wheel sets, including time reference snails and/or stars, and particularly a minute snail, a quarter snail and an hour snail.

Figure 40:
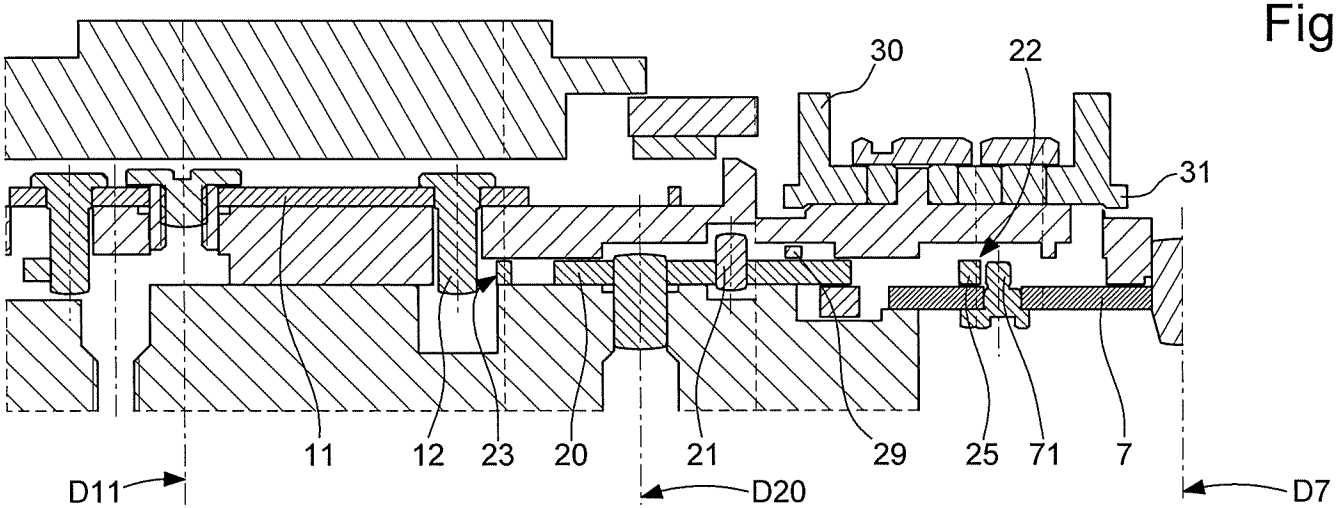
Figure 41:
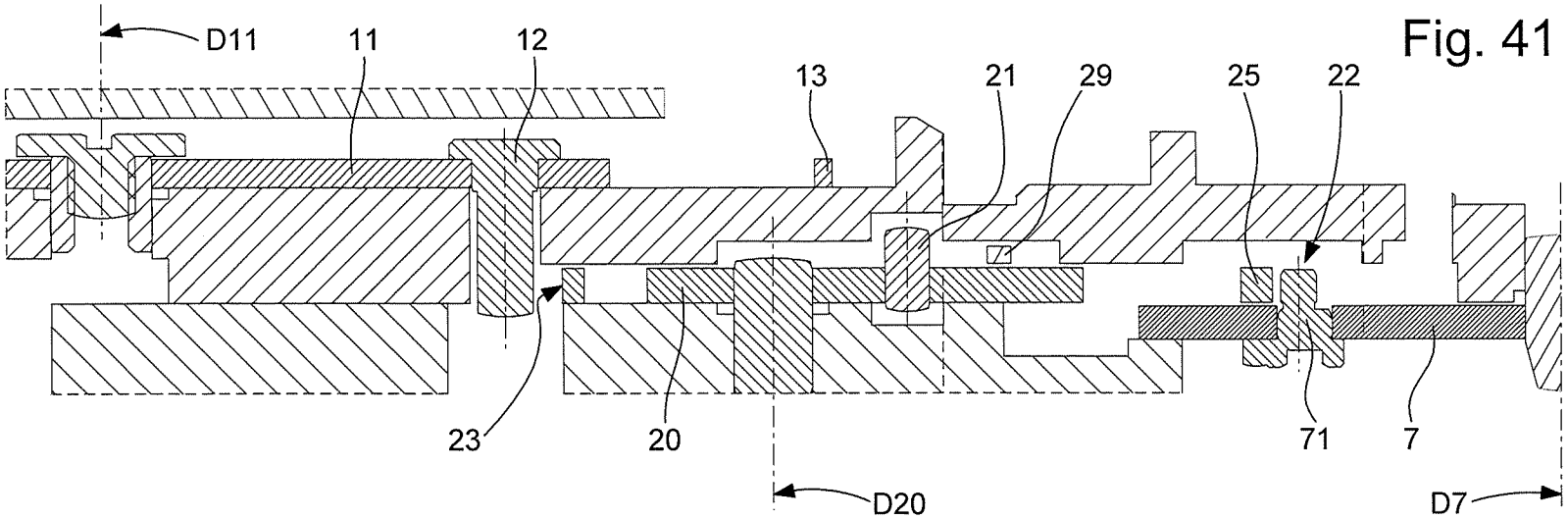

This striking mechanism 100 also includes at least one strike drive wheel set 1, as explained in particular in the chapter on 'Clock Watches' in '*Les montres compliquées*' and visible, in particular, in FIG. 40 of this book. This strike drive wheel set 1 conventionally includes a release ratchet 2 and a rack pinion.

Figures 25, 26, 27, 28, 29, 30, 31, 32, 50:
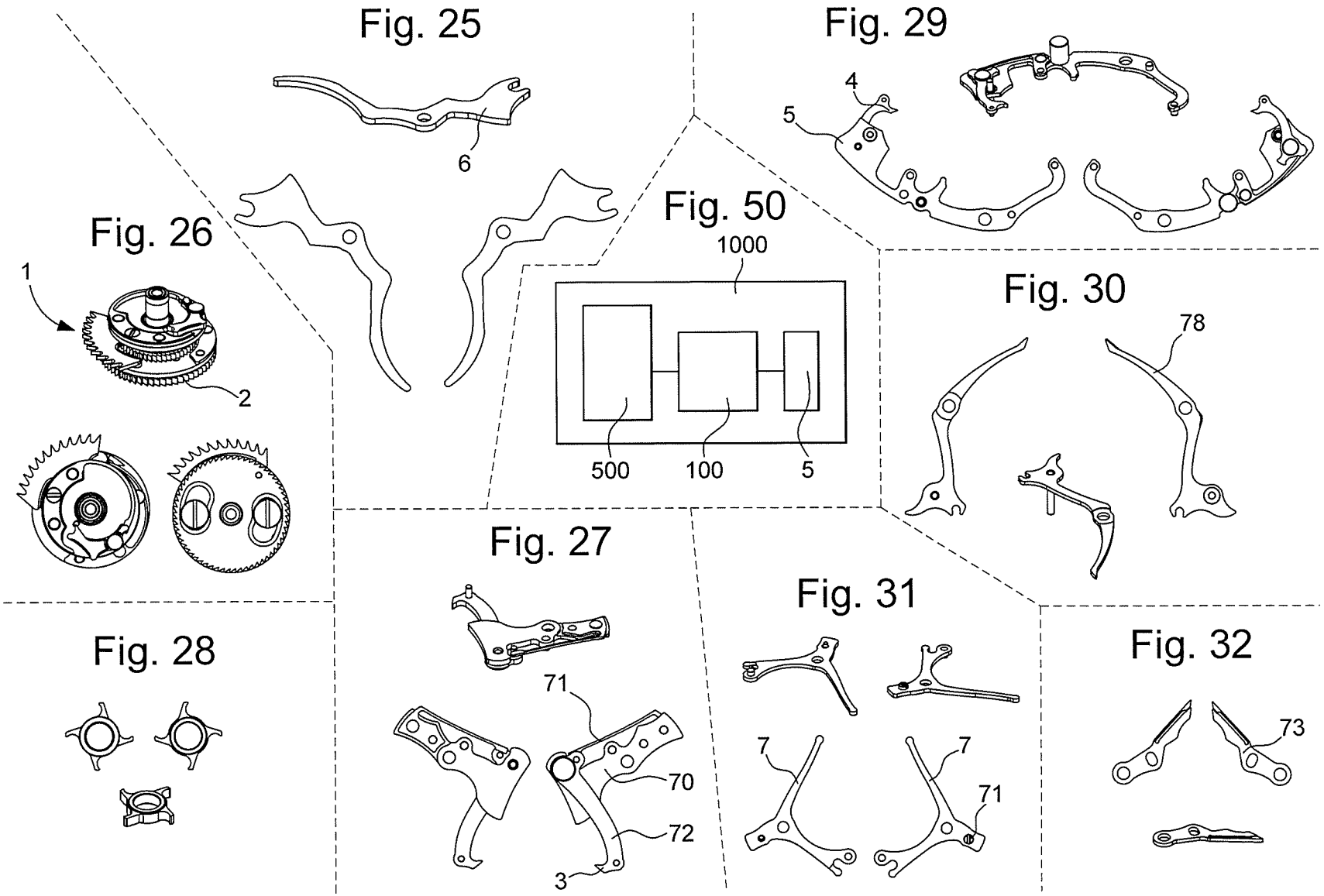
FIGS. 25 to 38 each represent schematic, perspective, back and front views of the main components of the striking mechanism.
FIG. 50 is a block diagram representing a timepiece with a movement, a manual control member for the on-demand acoustic display function, and a striking mechanism according to the invention.
Figure 36:
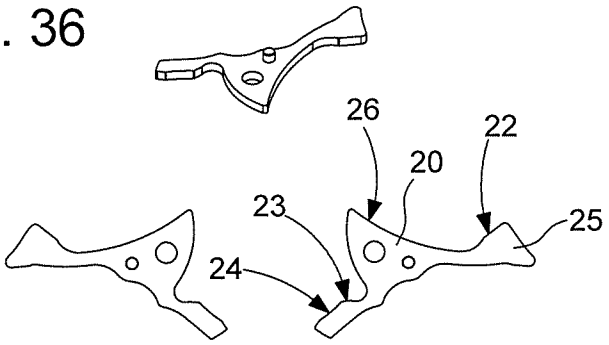
Figure 37:
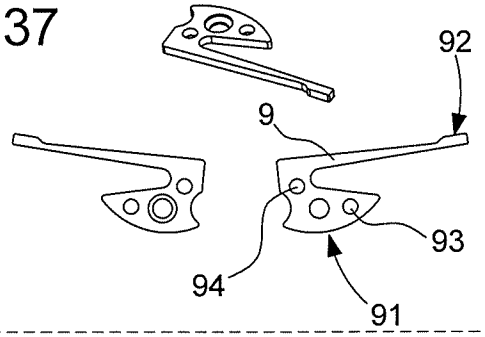
Figure 38:
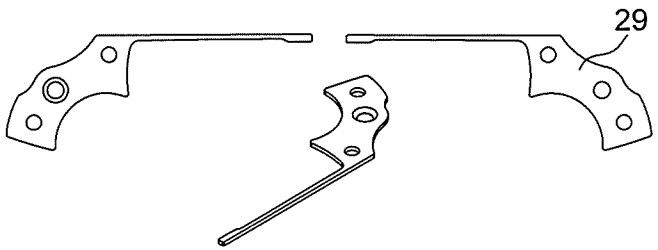
Figure 33:
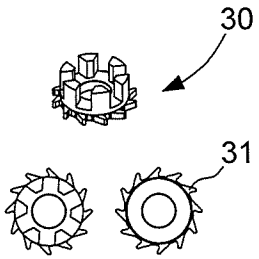
Figure 34:
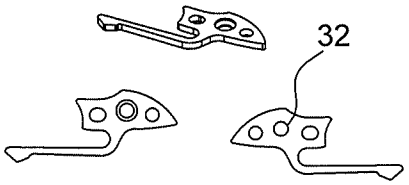
Figure 35:
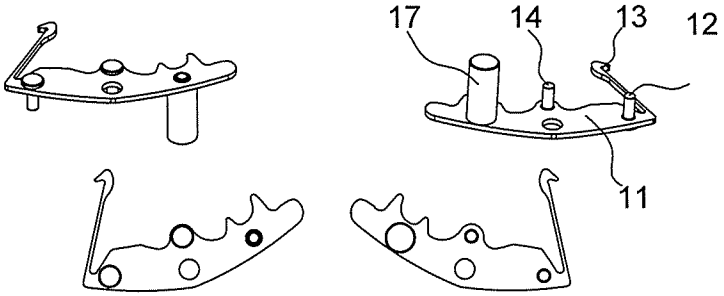
Figure 39:
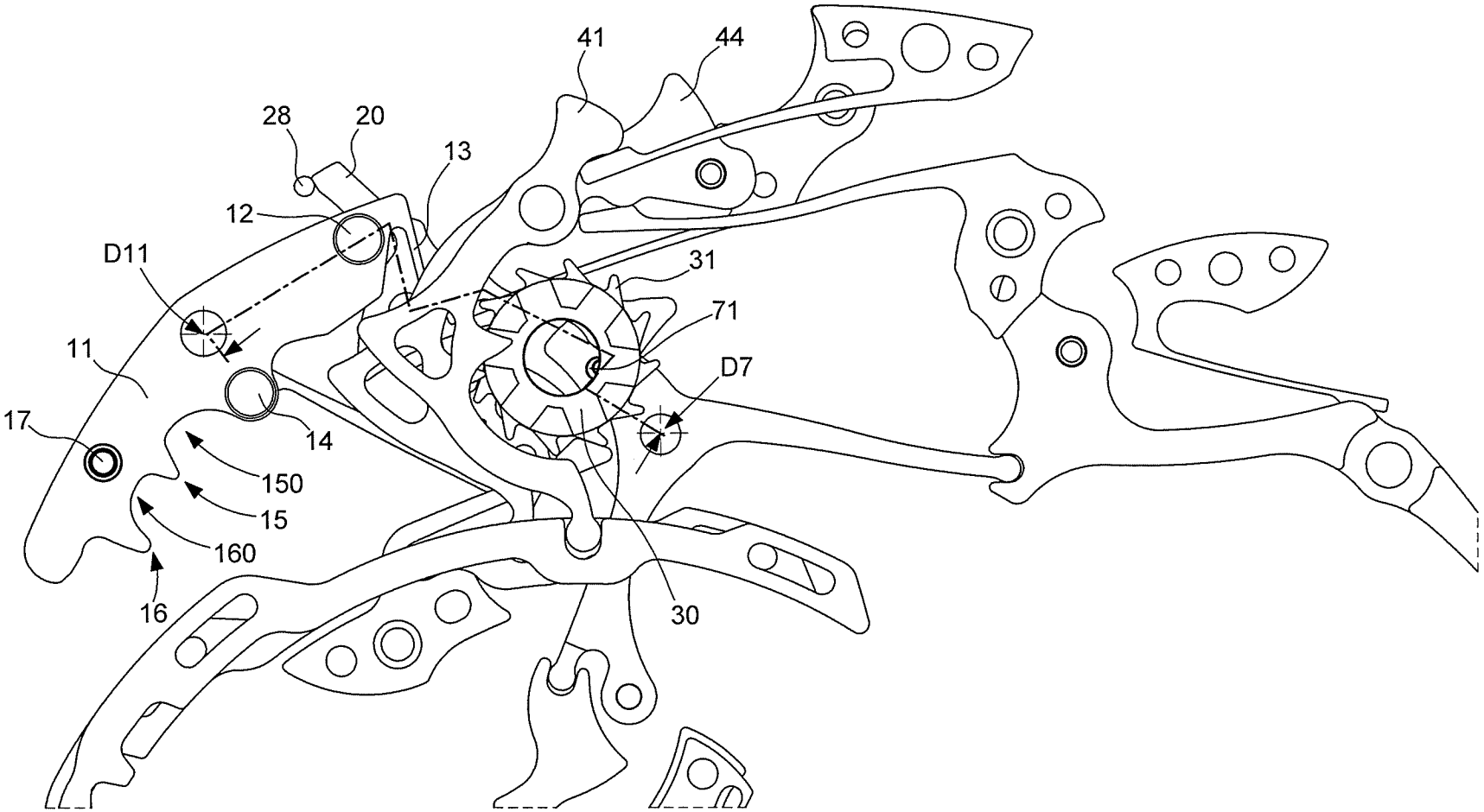
FIG. 39 is a similar view to FIG. 2, in which is indicated, in dot and dash lines, a cross-sectional trajectory on which is visible the cross-section of FIG. 40 and the detail thereof in FIG. 41.

Striking mechanism 100 cooperates with movement 500, which drives the reference wheel set(s) and a particular output of which is illustrated in FIG. 28, in the non-limiting form of a star for releasing the striking mechanism by the movement, fitted onto a cannon-pinion, and including four teeth, in order to lift, at each quarter hour, an intermediate lever for release by the movement, referred to hereinafter as a gathering pallet.

Strike drive wheel set 1 thus carries a detent ratchet 2, which is arranged to cooperate with at least one passing strike actuation click 3 controlled by movement 500, particularly through cooperation between the star of FIG. 28 and the engagement yoke 73 of FIG. 32, and as explained in Swiss Patent Application No. CH00964/17 by the same Applicant, or a repeater click 4 controlled by an on-demand release lever 5, seen in FIG. 29, operable by a user, for example to control a minute repeater or suchlike, and as explained in the same Swiss Patent Application No. CH00964/17 by the same Applicant.

Striking mechanism 100 includes a strike-uncoupling lever 6 able to prevent access of such a click 3, 4 to detent ratchet 2, under the action of a strike reversing lever 7, as described in Swiss Patent Applications CH00964/17, CH00965/17, CH00966/17 by the same Applicant. This strike reversing lever 7 is operable, either by a hand-setting stem 8 comprised in movement 500, or by a main control member 10 for selecting the strike function or tune, comprised in striking mechanism 100, or by a stopping mechanism in case of insufficient energy resource comprised in striking mechanism 100. Such a stopping mechanism, arranged to prevent any strike function being started when the striking power reserve, notably in a striking barrel or similar, is depleted or insufficient, is not illustrated in detail here, and forms the subject of Swiss Patent Application CH00964/17 by the same Applicant.

According to the invention, the striking mechanism includes a device to prevent release during selection of a strike function or tune, which is arranged to prevent the release of any strike function, either by movement 500 or by a user. This release-prevention device includes a release-prevention lever 20, the pivoting of which, when a strike function or tune selection is made on main control member 10 by a user, moves every click 3, 4 away from detent ratchet 2. Striking mechanism 100 includes elastic return means, which are arranged to return main control member 10 to a unique rest position in the absence of action by a user.

More particularly, main control member 10 includes a pivoting main operating lever 11, which carries a control pin 12. This control pin 12 is arranged to abuttingly engage, under the action of a main operating spring 9, with a first surface 23 of release-prevention lever 20 in a first angular travel allowing release operations, and with a second surface 24 of release-prevention lever 20 in a second angular disengagement travel of release-prevention lever 20 preventing any operations to release the striking mechanism. Release-prevention lever 20 is pushed towards control pin 12 by the return force of a release-prevention lever spring 29. Movement 500 includes a fixed pin 28 which serves as a support position for release-prevention lever 20 when the latter is in the rest position.

Figures 1, 2, 3, 4:
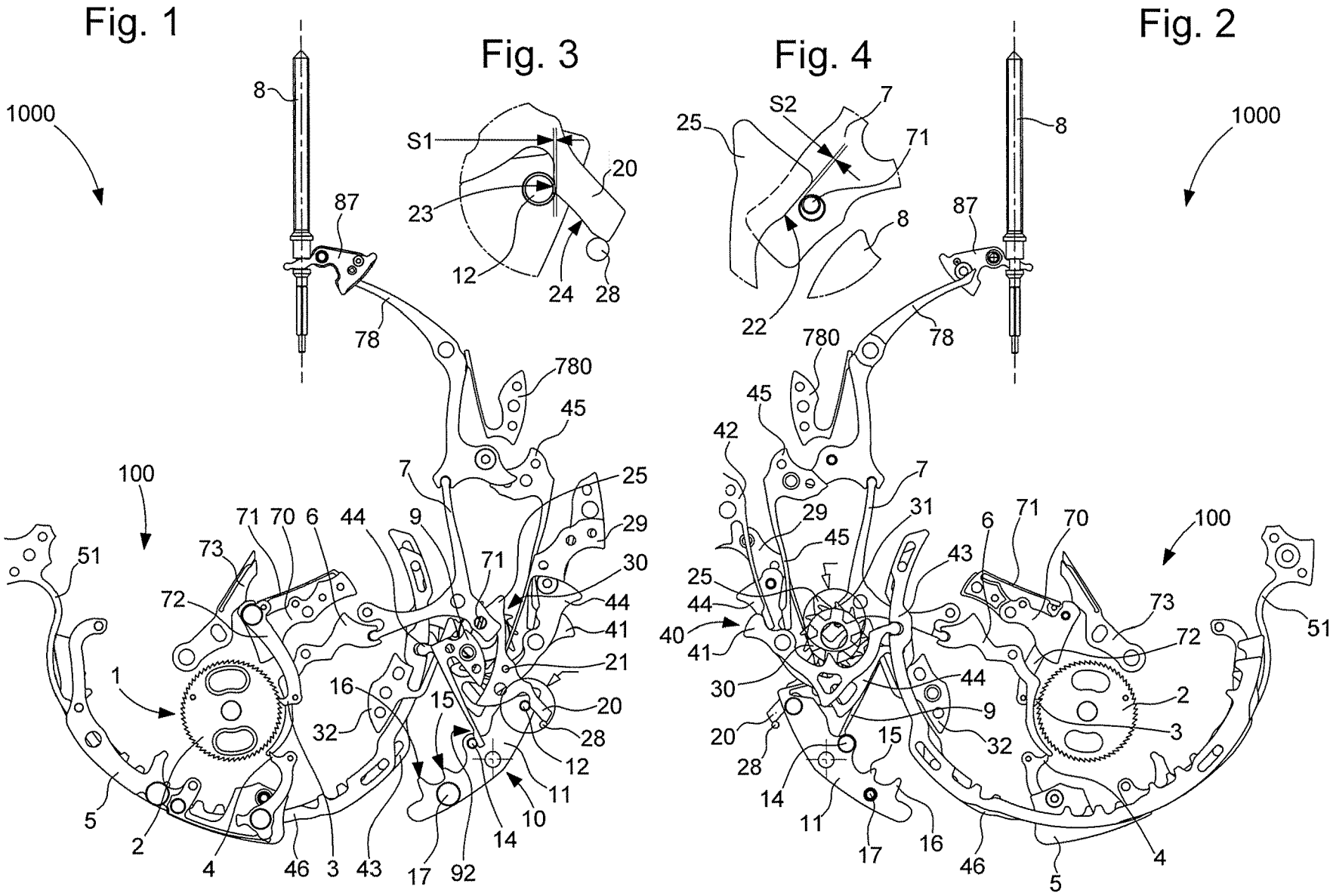

In the rest position of main control member 10, control pin 12 faces first surface 23, from which it is separated by a first, non-zero, safety distance 51, as seen in FIG. 3.

Figures 5, 6, 7, 8:
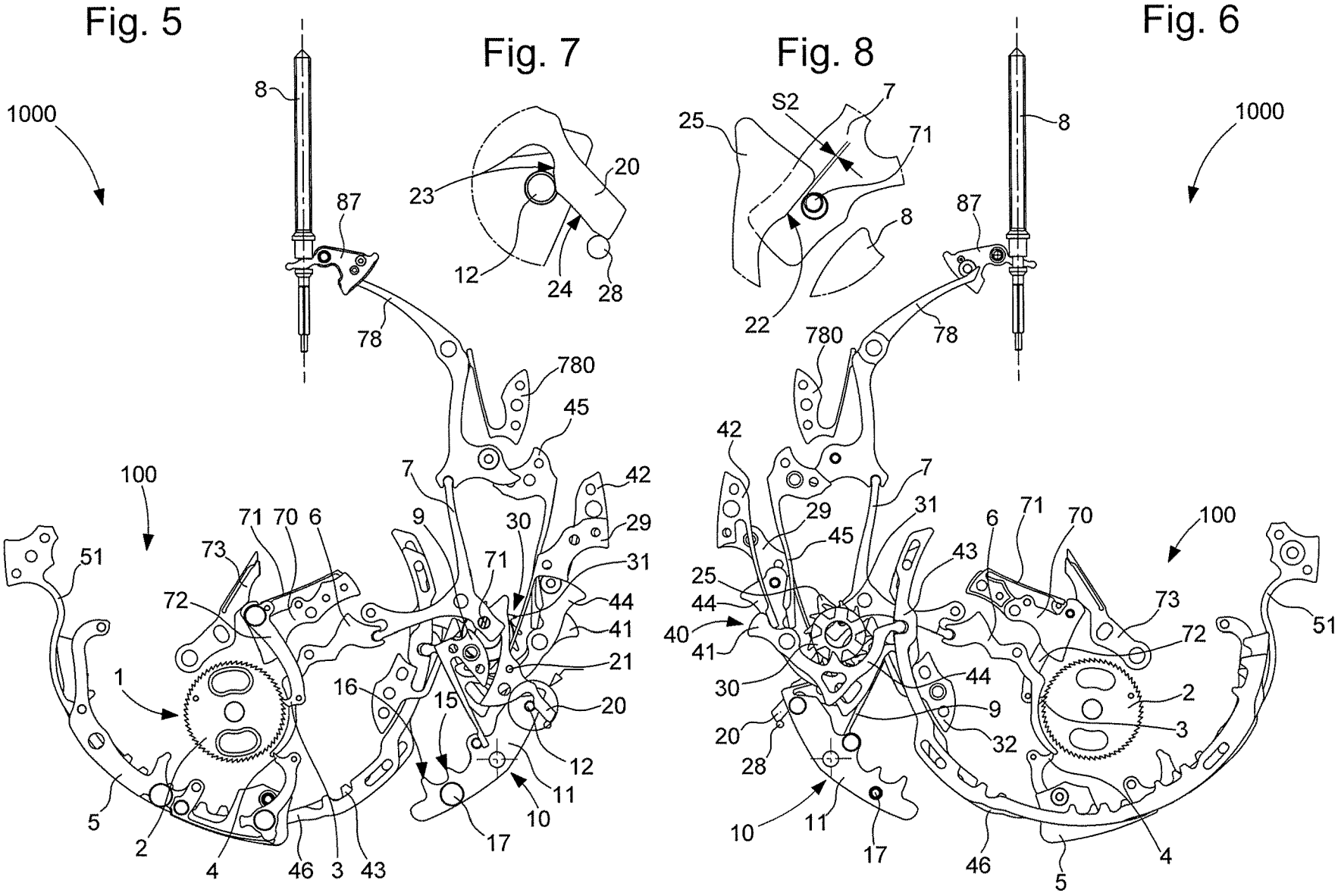
Figures 9, 10, 11, 12:
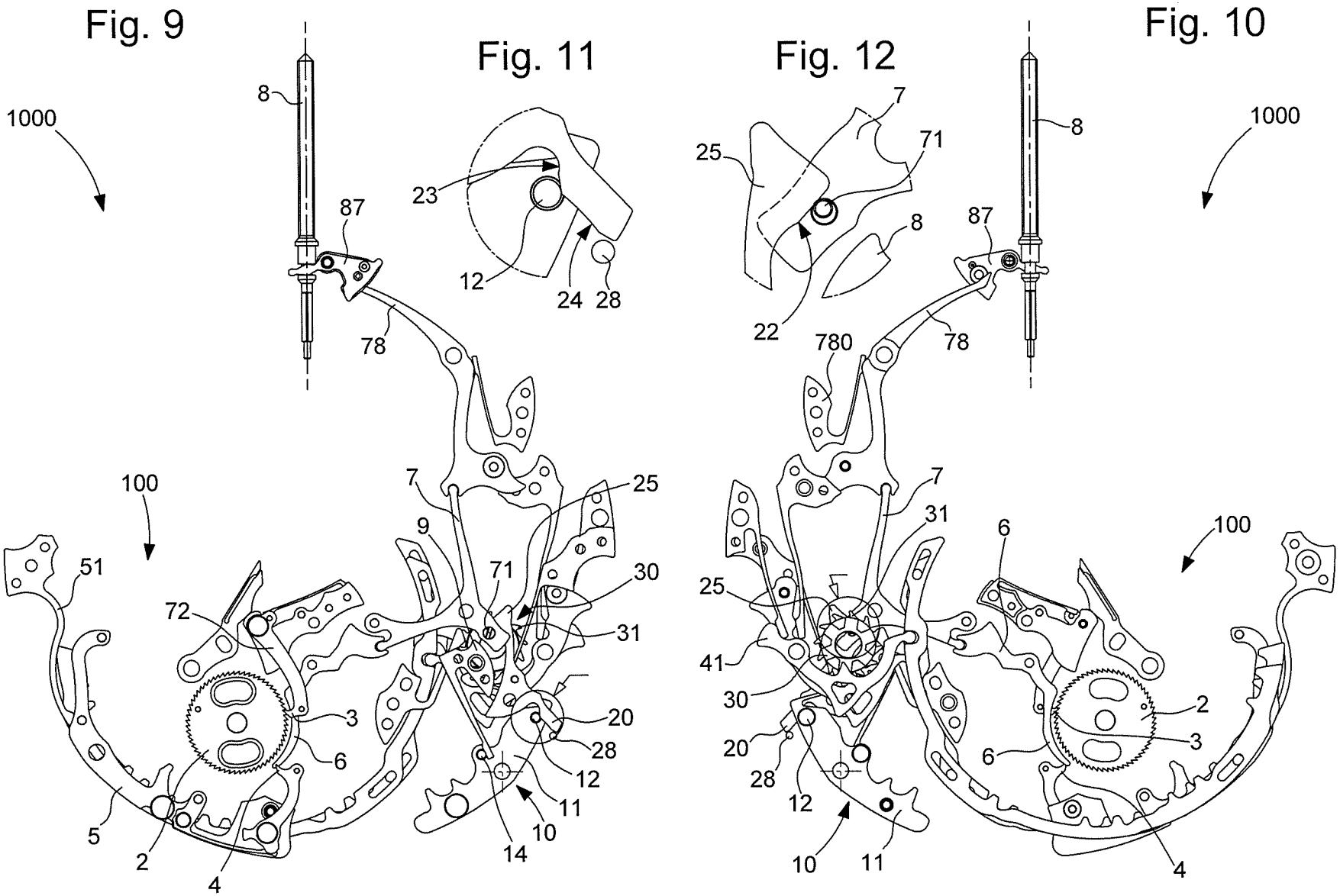

During the first angular travel, control pin 12 rests on first surface 23, as seen in FIG. 7, where release-prevention lever 20 rests on a fixed pin 28 of movement 500, at the start of action on the pusher of main control member 10, whereas, in FIG. 11, control pin 12 is still resting on first surface 23, but release-prevention lever 20 is no longer resting on fixed pin 28.

Figures 17, 18, 19, 20:
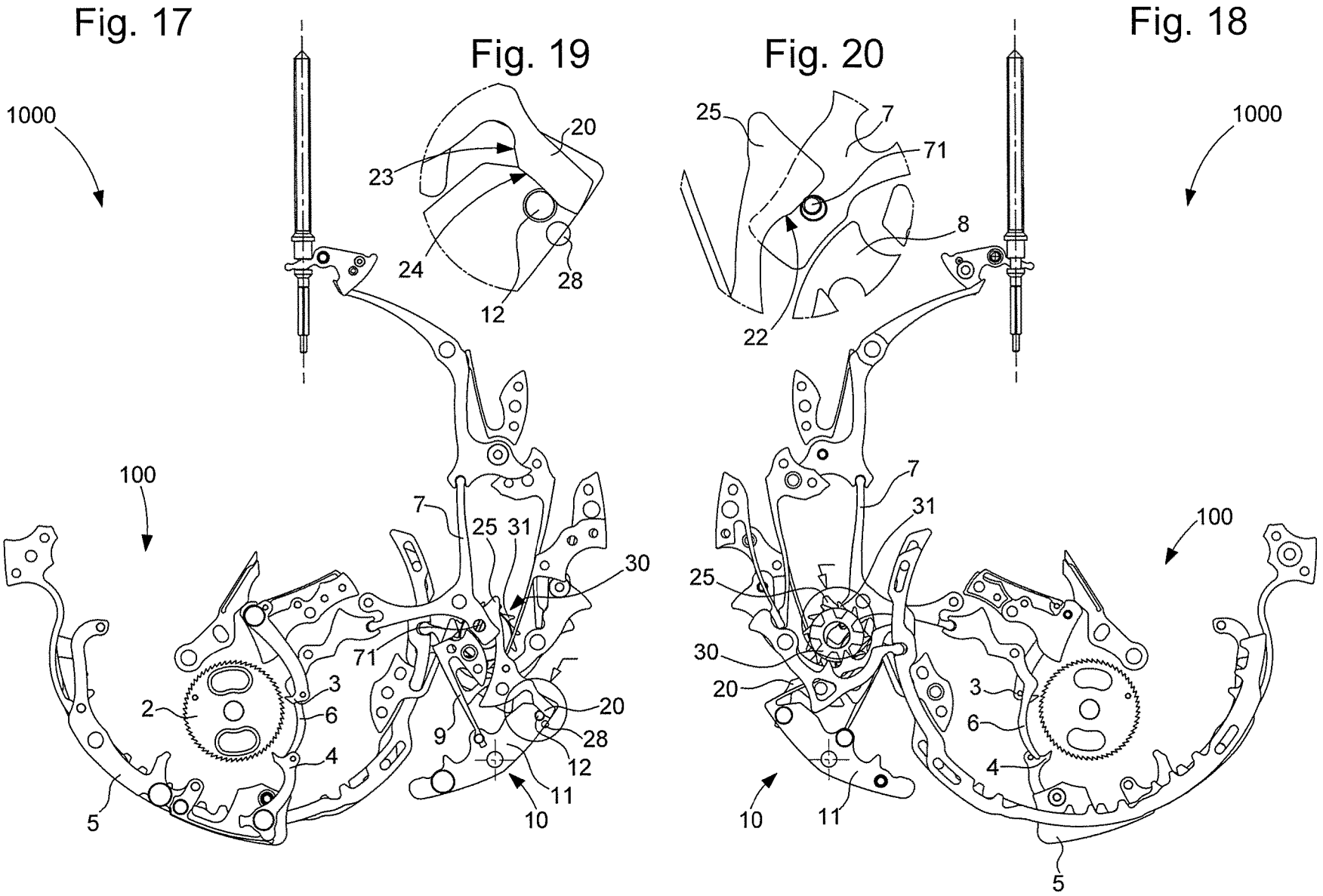
Figures 21, 22, 23, 24:
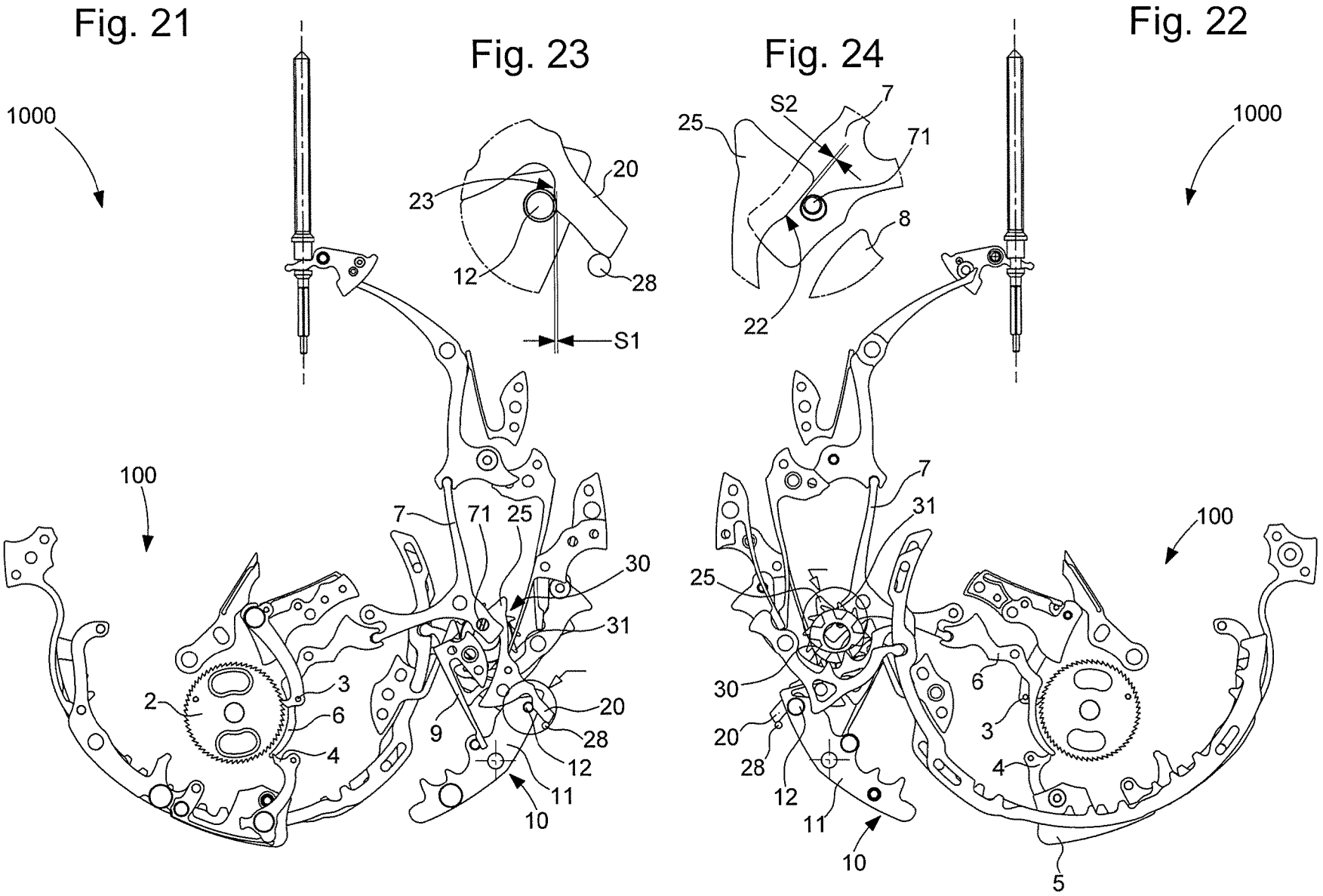
FIGS. 21 to 24 illustrate the return to the rest position.

During the second angular travel, control pin 12 rests on second surface 24, while a force is exerted on main control member 10 by a user, as seen in FIGS. 15 and 19, where release-prevention lever 20 is remote from fixed pin 28.

More particularly, the second surface 24 of release-prevention lever 20 is adjacent to first surface 23, from which it is separated by an edge or by an intermediate flat portion, the crossing of which, during action on main control member 10 corresponds to the end of the first angular travel, and to the engagement of the safety device preventing the release of any strike function.

In the non-limiting variant illustrated by the Figures, first surface 23 is substantially flat, and is separated from second, substantially cylindrical surface 24, by an edge. Second surface 24 is coaxial with the axis of pivoting of main operating lever 11 when the safety device is activated.

In another, non-illustrated variant, first surface 23 and second surface 24 are two substantially cylindrical surfaces, which are substantially centred on the axis of pivoting of main operating lever 11, one of which is further away than the other, and which are separated by an intermediate flat portion. Likewise, second surface 24 is coaxial with the axis of pivoting of main operating lever 11 when the safety device is activated.

Other arrangements are naturally possible, and depend, in particular, on the space available in proximity to main control member 10, which includes, in the variant illustrated by the Figures, a main operating lever 1 on which a user-operated pusher (not represented) acts.

Advantageously, strike reversing lever 7 includes an eccentric 71, which is arranged to move into abutment on a bearing surface 22 comprised in release-prevention lever 20, for fine adjustment of the pivoting travel of strike reversing lever 7, and to ensure disengagement of each click 3, 4 with respect to detent ratchet 2.

When control pin 12 comes into contact with first surface 23 of release-prevention lever 20, the latter comes into contact with eccentric 71 via its bearing surface 22.

This safety device is activated during the idle travel of main operating lever 11: while control pin 12 moves over first surface 23, the safety distance gradually changes from the value of second safety distance S2 to the value zero, and strike reversing lever 7 starts its travel to drive strike-uncoupling lever 6 which disconnects the two clicks 3, 4, holding them at a distance from detent ratchet 2.

When the user makes a tune selection by action on main operating lever 11, control pin 12 moves from first surface 23 to second surface 24 of release-prevention lever 20. Consequently, main operating lever 11 comes into contact, via its bearing surface 22, with eccentric 71 of strike reversing lever 7, which then disconnects clicks 3, 4, by the connection with strike-uncoupling lever 6.

In another non-illustrated variant, strike reversing lever 7 carries a simple pin arranged to cooperate with bearing surface 22. In yet another non-illustrated variant, strike reversing lever 7 has an aperture arranged to cooperate with a pin of release-prevention lever 20, or with a pin fixed to the plate of movement 500.

More particularly, in the rest position of main control member 10, eccentric 71 faces bearing surface 22 from which it is separated by a second, non-zero distance S2, as seen in FIG. 4.

During a first part of the first angular travel, this eccentric 71 faces bearing surface 71 from which it is still separated by a second, non-zero distance S2, as seen in FIG. 8, at the same instant as in FIG. 7, at the start of action on the pusher of main control member 10, whereas control pin 12 is resting on first surface 23, and release-prevention lever 20 is resting on fixed pin 28.

During a second part of the first angular travel, consecutive to the first part, as seen in FIG. 12, at the same instant as in FIG. 11, eccentric 71 rests on bearing surface 22.

During the second angular travel, eccentric 71 rests on bearing surface 22, while a force is exerted on main control member 10 by a user, as seen in FIG. 16, at the same instant as in FIG. 15, which correspond to the end of the idle travel and to the end of the safety device engagement phase, and in FIG. 20, at the same instant as in FIG. 19, and which corresponds to the end of the pusher travel, the selection then being made, for example in the form of a change of tune or strike mode, or gong selection, or otherwise. This arrangement prevents any breakage of the mechanism.

In the non-limiting version illustrated by the Figures, main strike or tune selection control member 10 includes a column wheel 30. Main operating lever 11 is, in this case, a main column wheel operating lever, which includes a hook 13, which is arranged to pull teeth 31 of column wheel 30, which is held in position by a column wheel jumper 32. Main operating spring 9 is then a main column wheel operating spring, which includes at least one pin 93, 94 for the positioning thereof. European Patent Nos. EP3096189B1 and EP3136188B1 by the same Applicant explain the operation of such a column wheel, in combination with such an operating lever.

The first angular travel, during which control pin 12 rests on first surface 23 of release-prevention lever 20, corresponds to the idle travel of main column wheel operating lever 11, i.e. this main column wheel operating lever 11 has not yet come into contact with column wheel 30.

It is only first surface 23 that engages the safety device according to the invention. Second surface 24 of release-prevention lever 20 allows this safety device to remain active during the continuing travel of control pin 12 of main column wheel operating lever 11.

Other, non-illustrated variants may include alternative types of selectors to a column wheel, the hook is in that case replaced by a control member suitable for such use. It is, in particular, possible to implement a cam selector, or a sliding piece selector as in a chronograph. European Patent No. EP2947523B1 by the same Applicant thus illustrates tune selection means. Swiss Patent Application Nos. CH00964/17, CH00965/17, CH00966/17 by the same Applicant disclose a strike mode selector which includes a cam selector.

In the illustrated variant with a column wheel, the first part of the first angular travel corresponds to an idle travel of the main column wheel operating lever 11, between the rest position and the first contact between hook 13 and column wheel 30.

In a particular variant, release-prevention lever 20 has a support radius 26, which is a mechanical safety stop.

In a particular variant, strike reversing lever 7 is arranged to control a display, visible to a user, of the operating or inoperative strike mode, according to its angular position. This display can, in particular, be controlled by a disengagement yoke 78, articulated on strike reversing lever 7 and in indirect connection with control stem 8 of the movement, whose operation is explained in Swiss Patent Application No. CH00964/17 by the same Applicant, relating to a stopping mechanism for a striking mechanism, and said disengagement yoke 78 carries a shutter seen through an aperture, or a hand, or otherwise, to inform the user as to the availability or non-availability of the strike functions.

The mechanism is also advantageously devised to prevent action on the selection mechanism when a passing strike function or a minute repeater is operating. To this end, more particularly, striking mechanism 100 includes, in a conventional manner, at least one control rack, which is a quarter rack or a minute rack for striking the time automatically or on demand and includes at least one cam, which is associated with the control rack, and which is arranged to prevent main control member 10 pivoting to select a strike mode or tune when a strike function or tune is in progress, as explained in European Patent EP3096189B1 by the same Applicant, wherein, for each level of a striking mechanism which has several levels, such a cam cooperates with the respective quarter rack to prevent any action on the control pusher when said quarter rack is moving to perform a strike function or play a tune. In particular, such a cam is advantageously arranged here to cooperate with a minute rack, and to pivot and lock main operating lever 11 when a strike function or tune is being performed.

FIGS. 42 to 49 illustrate the advantageous case where this complementary safety mechanism cooperates with minute rack 90, which is the last to play during performance of a strike function, and which has the function of stopping the strike regulator at the end of the cycle. This complementary safety mechanism is intended to prevent a selection being made when a passing strike or strike function started by a minute repeater or similar is operating, and includes a tune selection-prevention lever 95, which is arranged to move into abutment on minute rack 90, by a beak 97 comprised therein.

Figure 42:
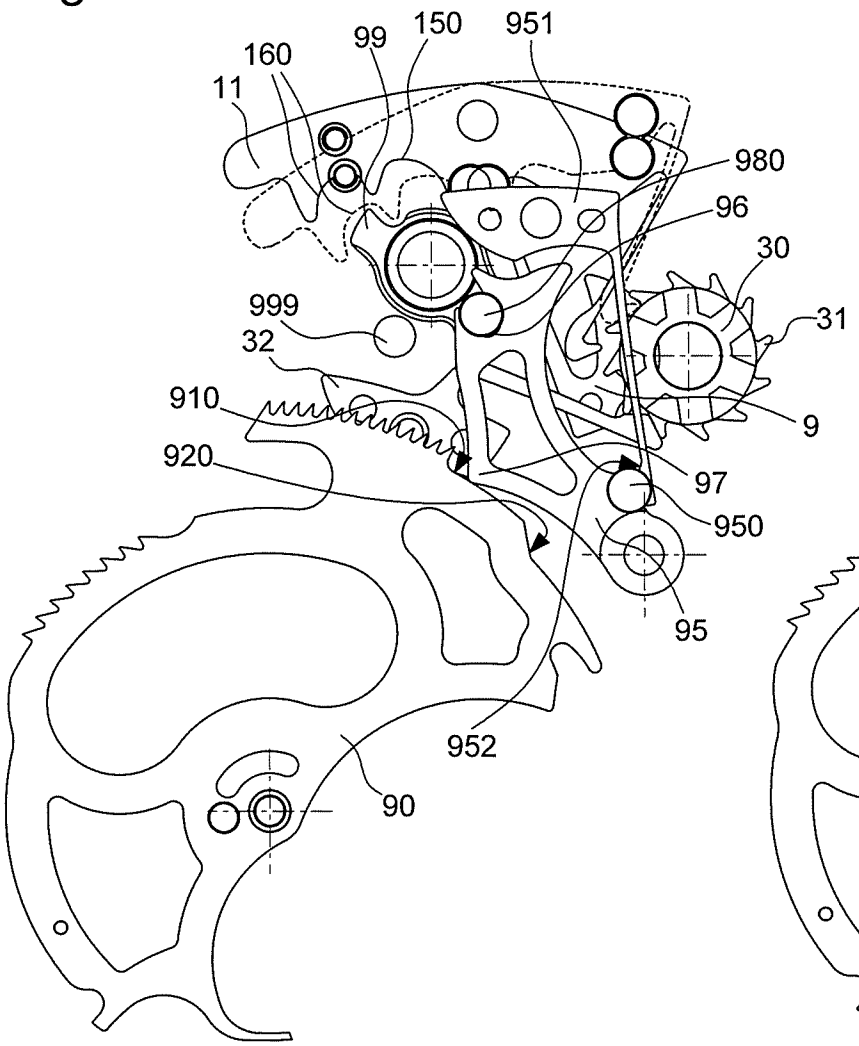
Figure 44:
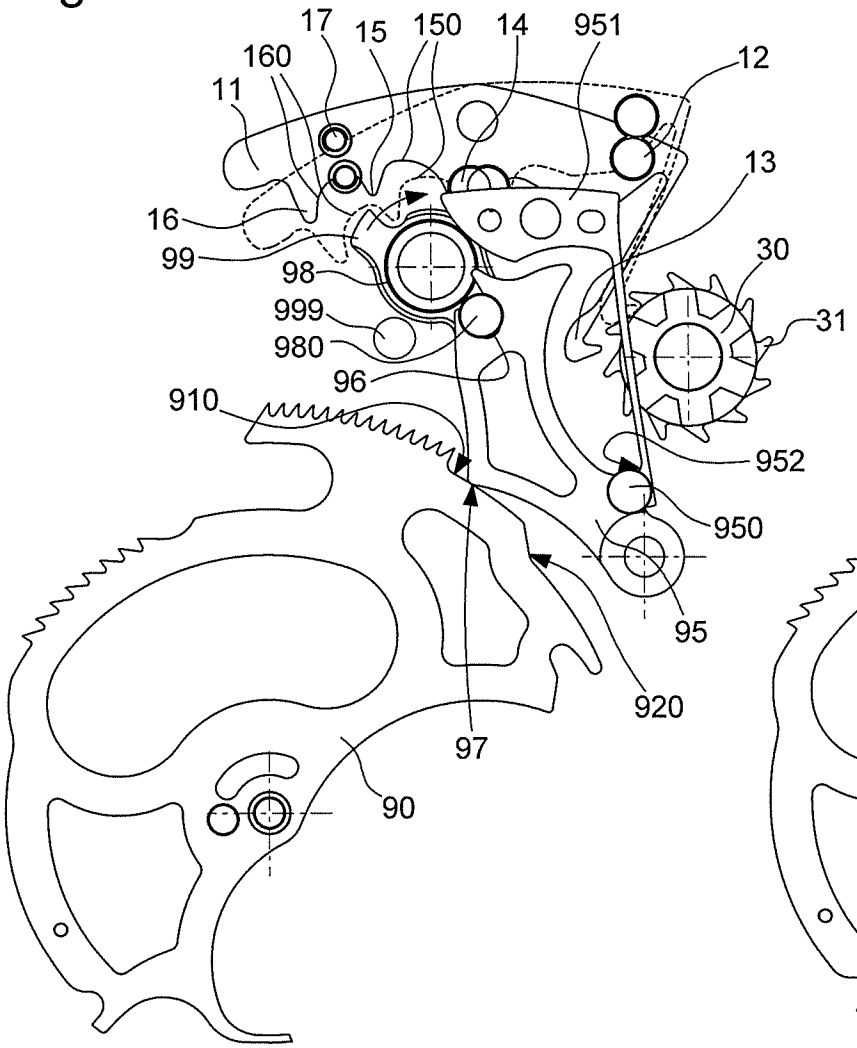
Figure 47:
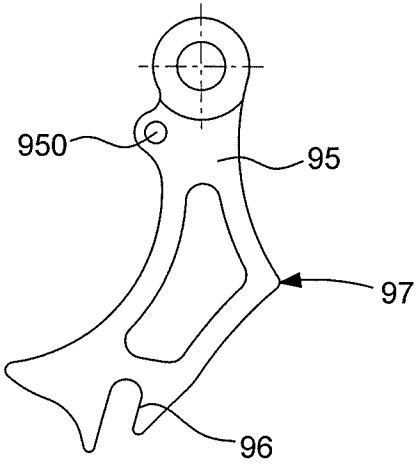
Figure 49:
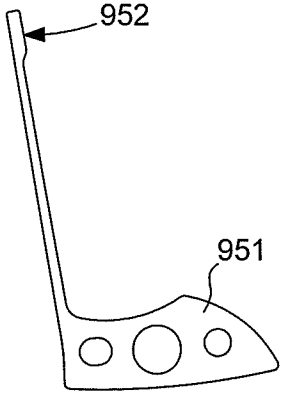
Figure 46:
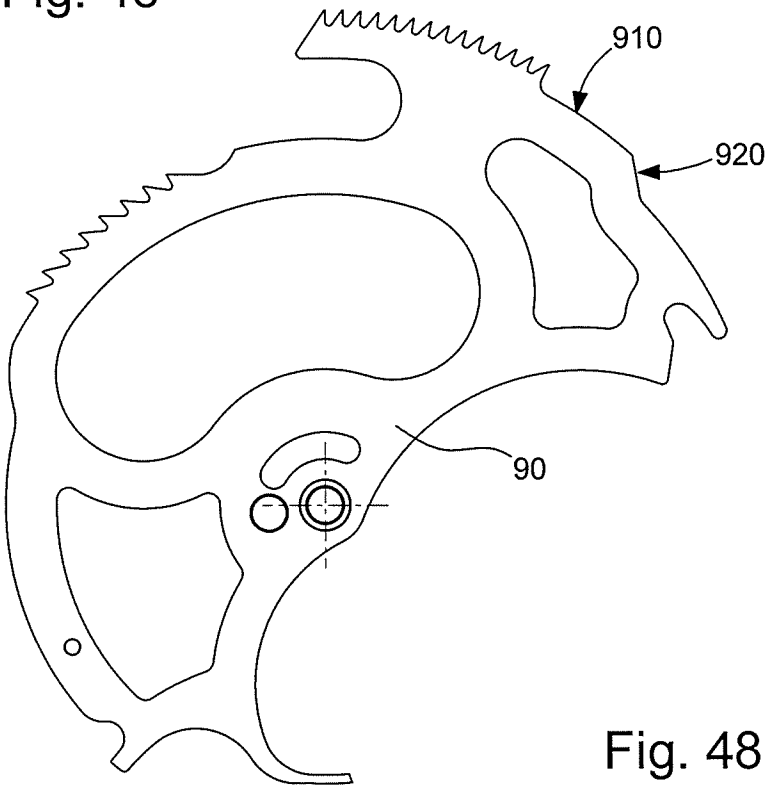
Figure 48:
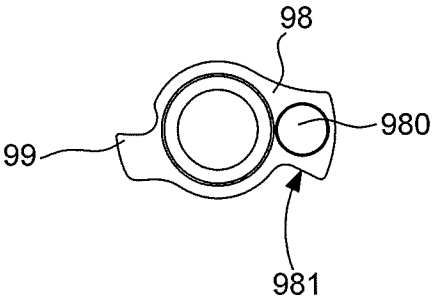

FIGS. 42 and 44 show the striking mechanism at rest, this beak 97 is resting on a path 910 of minute rack 90, concentric to its axis of pivoting. Tune selection-prevention lever 95 includes a fork 96 for articulation with a post 980 comprised in a tune selection bolt 98 mounted to pivot on a bridge. This bolt 98 is a cam, and includes a finger 99 capable of occupying, depending on the angular position of bolt 98, either a position inside a notch 150 in main operating lever 11, delimited by a threshold piece 15, or a position facing threshold piece 15, in a position where the safety device is engaged. A tune selection-prevention lever spring 951 pushes, via an arm 952, tune selection-prevention lever 95 towards minute rack 90.

Figure 43:
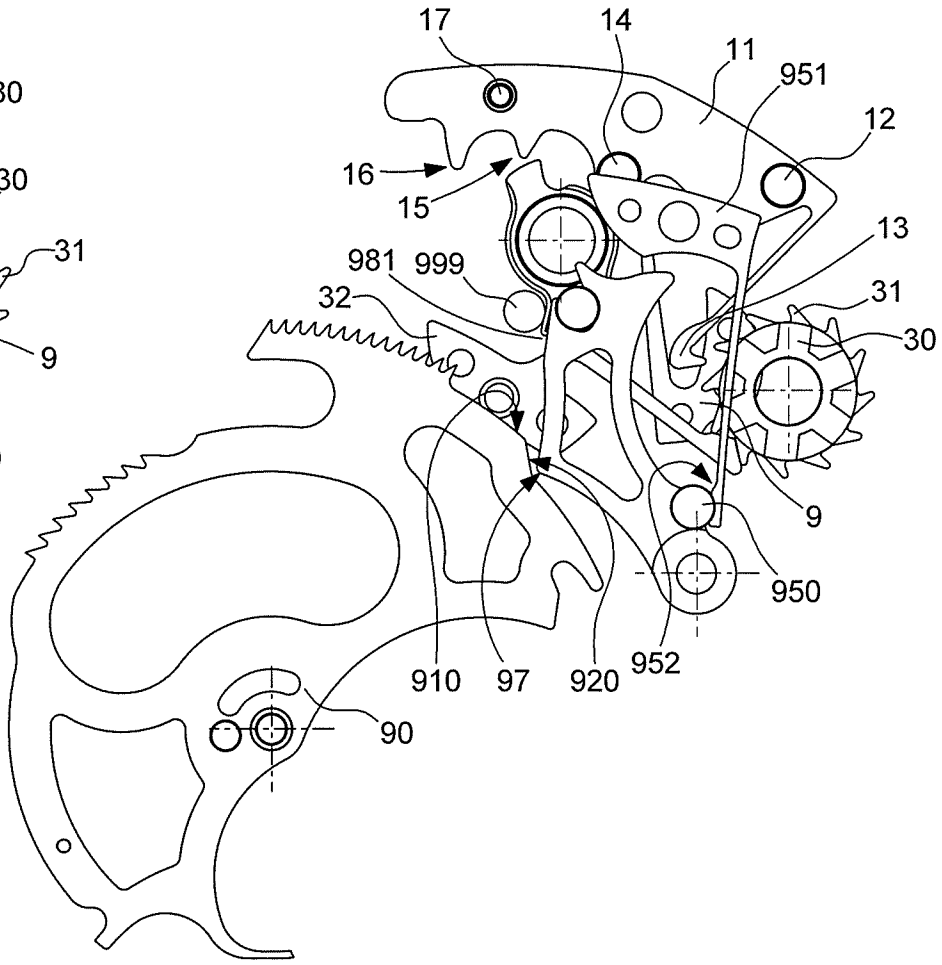
FIGS. 42 to 49 illustrate, in plan views, a complementary safety mechanism, together with a minute rack comprised in the striking mechanism, and which is intended to prevent selection being made during operation of a passing strike or strike function activated by a minute repeater or similar, this complementary safety mechanism including a tune selection-prevention lever arranged to move into abutment on the minute rack, and articulated with a strike selection bolt, which is arranged to cooperate with the main operating lever.
Figure 45:
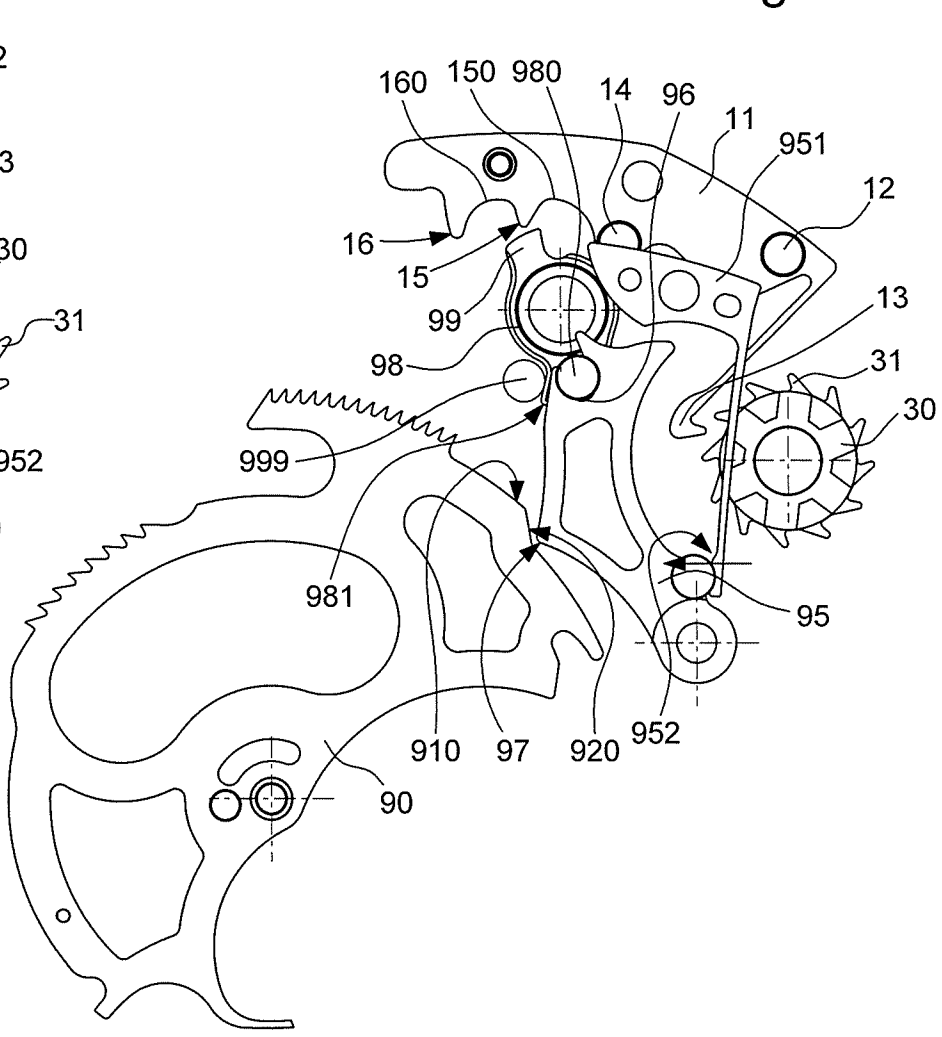

When the strike function is being performed, in FIGS. 43 and 45, minute rack 90 pivots, in the anticlockwise direction in these Figures, beak 97 leaves path 910 and escapes along a release ramp 920, finger 99 moves opposite threshold piece 15 and at the same time, tune selection-prevention lever 95 and bolt 28 pivot, the latter in a clockwise direction in the Figure.

A pin 999 of the bridge obstructs a bearing face 981 of bolt 98. The safety device is engaged and will only be disengaged again when minute rack 90 returns to its rest position, after the strike function is completed. European Patent EP3096189B1 illustrates alternative variants of this complementary safety mechanism.

Striking mechanism 100 more particularly includes a minute repeater or another on-demand acoustic display, which includes an on-demand release lever 5 operable by a user to cause a repeater click 4 to cooperate with detent ratchet 2.

In a variant, the invention concerns only striking mechanism 100, which is arranged as an additional mechanism on a bridge of the striking mechanism that can be added to movement 500.

The invention makes it possible, independently of the other safety devices mentioned in the aforecited other patent applications and patents by the same Applicant, and in particular, independently of the stopping mechanism of Swiss Patent Application No. CH00964/17, to ensure total safety of the strike mode and/or tune selection function.

The invention claimed is:

1. A timepiece comprising a movement and a striking mechanism, which includes a strike drive wheel set carrying a detent ratchet which is arranged to cooperate with at least one passing strike actuation click controlled by said movement or a repeater click controlled by a user-operated, on-demand release lever, said striking mechanism including a strike-uncoupling lever able to prevent access of a said click to said detent ratchet under the action of a strike reversing lever which is operable, either by a hand-setting stem comprised in said movement, or by a main strike or tune selection control member comprised in said striking mechanism, or, in case of insufficient energy resource, by a stopping mechanism comprised in said striking mechanism, wherein said striking mechanism includes a safety device for preventing release during selection of a strike function or tune, which is arranged to prevent the release of any strike function, either by said movement or by a user, and which includes a release-prevention lever, the pivoting of which, when a strike function or tune selection is made on said main control member by a user, moves any said click away from said detent ratchet, and wherein said striking mechanism includes elastic return means for returning said main control member to a unique rest position in the absence of action by a user.

2. The timepiece according to claim 1, wherein said main control member includes a pivoting main operating lever, which carries a control pin which is arranged to abuttingly engage, under the action of a main operating spring, with a first surface of said release-prevention lever in a first angular travel allowing release operations, and with a second surface of said release-prevention lever in a second angular disengagement travel of said release-prevention lever preventing any operations to release the striking mechanism, said release-prevention lever being pushed towards said control pin by the return force of a release-prevention lever spring.

3. The timepiece according to claim 2, wherein, in said rest position of said main control member, said control pin faces said first surface from which it is separated by a first, non-zero safety distance.

4. The timepiece according to claim 2, wherein, during said first angular travel which corresponds to an idle travel of said main operating lever, said control pin rests on said first surface which is arranged to engage said release-prevention device.

5. The timepiece according to claim 2, wherein, during said second angular travel, said control pin rests on said second surface, while a force is exerted on said main control member by a user, to maintain said release-prevention safety function.

6. The timepiece according to claim 2, wherein said second surface of said release-prevention lever is adjacent to said first surface, from which it is separated by an edge or by an intermediate flat portion, the crossing of which during action on said main control member corresponds to the end of said first angular travel, and to the engagement of the safety device preventing the release of any strike function.

7. The timepiece according to claim 6, wherein said first surface is substantially flat, and separated by an edge from said second surface which is substantially cylindrical and coaxial with the axis of pivoting of said main operating lever when the safety device is activated.

8. The timepiece according to claim 6, wherein said first surface and said second surface are two surfaces which are substantially cylindrical and substantially centred on the axis of pivoting of said main operating lever, one of which is further away than the other, and which are separated by an intermediate flat portion, and said second surface is coaxial with the axis of pivoting of said main operating lever when the safety device is activated.

9. The timepiece according to claim 2, wherein said strike reversing lever includes an eccentric arranged to move into abutment on a bearing surface comprised in said release-prevention lever, for fine adjustment of the pivoting travel of said strike reversing lever, and to ensure the disengagement of each said click from said detent ratchet.

10. The timepiece according to claim 9, wherein, in said rest position of said main control member, said eccentric faces said bearing surface from which it is separated by a second, non-zero safety distance.

11. The timepiece according to claim 9, wherein, during a first part of said first angular travel, said eccentric faces said bearing surface from which it is separated by a second, non-zero safety distance.

12. The timepiece according to claim 11, wherein, during a second part of said first angular travel, consecutive to said first part, said eccentric rests on said bearing surface.

13. The timepiece according to claim 2, wherein said main strike function or tune selection control member includes a column wheel, and wherein said main operating lever is a main column wheel operating lever, which includes a hook arranged to pull teeth of said column wheel, which is held in position by a column wheel jumper.

14. The timepiece according to claim 9, wherein, during said second angular travel, said eccentric rests on said bearing surface, while a force is exerted on said main control member by a user.

15. The timepiece according to claim 13, wherein said first part of said first angular travel corresponds to an idle travel between the rest position and the first contact between said hook and said column wheel.

16. The timepiece according to claim 1, wherein said strike reversing lever is arranged to control a display, visible to the user, of the operating or inoperative mode of the striking mechanism, according to its angular position.

17. The timepiece according to claim 1, wherein said striking mechanism includes at least one control rack which is a quarter rack or a minute rack for striking the time automatically or on-demand, and includes at least one cam associated with said control rack and arranged to prevent said main control member pivoting to select a strike mode or tune when a strike function or tune is in progress.

18. The timepiece according to claim 1, wherein said striking mechanism includes a minute repeater or another on-demand acoustic display, which includes a said on-demand release lever operable by a user to cause a repeater click to cooperate with said detent ratchet.

19. The timepiece according to claim 1, wherein the timepiece is a watch.

* * * * *